United States Patent [19]

Goeke

[11] Patent Number: 4,634,822

[45] Date of Patent: Jan. 6, 1987

[54] MULTIPLE OPERATION SWITCH LOCK

[75] Inventor: Alan G. Goeke, River Grove, Ill.

[73] Assignee: Fort Lock Corporation, River Grove, Ill.

[21] Appl. No.: 798,327

[22] Filed: Nov. 15, 1985

[51] Int. Cl.[4] ..... H01H 27/06

[52] U.S. Cl. ..... 200/43.08; 200/153 T; 70/379 R

[58] Field of Search ..... 200/43.08, 153 T; 70/DIG. 30, 277, 379 A, 379 R, 380

[56] References Cited

U.S. PATENT DOCUMENTS 3,600,915 8/1971 Corboud ..... 70/380

4,580,019 4/1986 Takahashi ..... 200/43.08

*Primary Examiner*—Stephen Marcus

*Assistant Examiner*—Renee S. Luebke

*Attorney, Agent, or Firm*—Leydig, Voit & Mayer

[57] ABSTRACT

A key actuated tubular lock capable of a plurality of locking operations, each with switch operating capability, includes a substantially cylindrical outer barrel, key actuated locking spindle means, including a stationary sleeve and a rotatable sleeve, disposed within the barrel and a multiple operation switch operating assembly rigidly attached in a removable manner and adapted to be operated by rotation of the locking spindle through use of a proper key. The multiple operation assembly includes a switch subassembly, having a microswitch and a switch operating member associated therewith, positioned within a switch retention area in the rear end portion of the barrel in such a way that the operating member is contacted so as to turn the microswitch "off" when the locking spindle is in a first position and "on" when the spindle is key actuated to a second position. The various components of the multiple operation switch assembly are adapted to be assembled according to a plurality of arrangements so that they coact differently with each other and with the stationary sleeve, thereby providing the plurality of locking operations for the lock along with switching capability.

16 Claims, 14 Drawing Figures

MULTIPLE OPERATION SWITCH LOCK

FIELD OF THE INVENTION

The present invention is related generally to key actuated lock mechanisms including electrical switching capabilities. More particularly, this invention relates to an improved switch lock which can provide a plurality of locking functions and is readily adaptable to provide electrical switching capabilities.

BACKGROUND OF THE INVENTION

The use of axial pin tumbular locks is well known and has been applied to numerous lock applications including those such as vending and dispensing machines. In many such applications the lock is required to provide more than one locking function. For example, it might be required that the lock provide key-pulls in more than one position. The application may dictate that in addition to the conventional 12 o'clock position, key-pulls be provided at say, 3 or 6 o'clock positions. Some other application may require only a momentary switch contact with key spring back. Conventional locks have attempted to provide such multiple operation capability but the resulting configurations have been complex. In addition, the shifting from one function to another has involved the disassembly of the complete lock mechanism and subsequent reassembly to obtain the new function. This makes the use of such locks extremely inconvenient, particularly in applications such as vending machines which are located on site and it is important that shifting of functions be accomplished without intricate manoeuvers.

The adaptation of mechanical key operated locks to incorporate electrical switch components typically has involved the use of a considerable number of individual parts stacked up on the rear end of the lock cylinder. Such arrangements present difficulties in the type of assembly operations that can be performed. Further, in such arrangements that combine the mechanical operation of the lock with electrical switching capability, the ability to disassemble the lock in order to either change keys or to change contact carrying elements has been either lost completely or provided only by means of specialty design.

One approach moving away from stack up arrangements of conventional switch locks is disclosed in U.S. Pat. No. 4,147,905 issued to Frank J. Scherbing. There, the pin tumbler sleeve and the electrical contact actuating elements are preassembled before insertion into the lock cylinder as a unit. This arrangement does reduce the number of parts as compared to a typical stacked up switch lock construction, but does not have the capability for providing optional features or different locking actions with the same switch actuating mechanism. A more recent approach, as disclosed in U.S. Pat. No. 4,394,551 issued to Frank J. Scherbing, discloses an electrical switch operating subassembly for a mechanical key actuated lock which is adaptable to commonly utilized lock sizes and may be disassembled for reaching or changing of switch contact elements. The essential components of this approach are two contact effecting interfitting members that are removably insertable in the lock cylinder and which coact with one another to make or break an electrical circuit on rotation of the lock operating spindle with the proper key. The switch operating subassembly also provides the rotational limits of the lock for switch "on" and switch "off" positions. Although this type of arrangement does provide adaptability to commonly utilized lock sizes and easy disassembly, it does not apply directly to a lock that has provision for multiple locking functions. Hence, there exists a need for a lock, specifically an axial pin tumbler lock, which has provision for multiple lock functions and is at the same time easily assembled and disassembled for rekeying or changing of switch contact elements or the like, and in addition, provides electrical switching capabilities.

SUMMARY OF THE INVENTION

Accordingly, it is the primary object of the invention to provide an improved mechanical key actuated lock which has the provision for multiple locking operations.

Another important object of the invention is to provide an improved mechanical key actuated lock of the above kind which also has electrical switching capabilities.

A further object is to provide such a multiple operation switch lock in a form which uses a minimum number of mechanical parts and allows convenient transfer from one locking function to another.

A related object is to provide such an improved switch arrangement which permits the various components of the lock to be easily disassembled for rekeying and changing of the switching elements.

The above objects are realized, in accordance with this invention, by designing the axial pin tumbler lock to be adapted to cooperate, in a number of different ways, with a multiple operation switch subassembly that couples the lock to an electrical switching mechanism. Depending upon the particular manner in which this assembly is arranged to cooperate with the lock, different locking functions, such as single or double key pulls or momentary switch contact with key spring back, may be provided for the lock assembly, while providing electrical switching capability for each of these locking functions.

As will be discussed in detail below, the various components of this lock are designed to be easily disassembled and reassembled so that transfering the lock from one locking action to another is made simple and convenient.

BRIEF DESCRIPTION OF THE DRAWINGS

These and other objects of the invention will become apparent from the description below when taken in conjunction with the following drawings, in which.

While the invention will be described in connection with certain preferred embodiments, it will be understood that it is not necessarily intended to limit the invention to those embodiments. On the contrary, it is intended to cover all alternatives, modifications and equivalents as may be included in the spirit and scope of the invention as defined by the appended claims.

DETAILED DESCRIPTION OF THE PREFERRED EMBODIMENT

Figure 1:
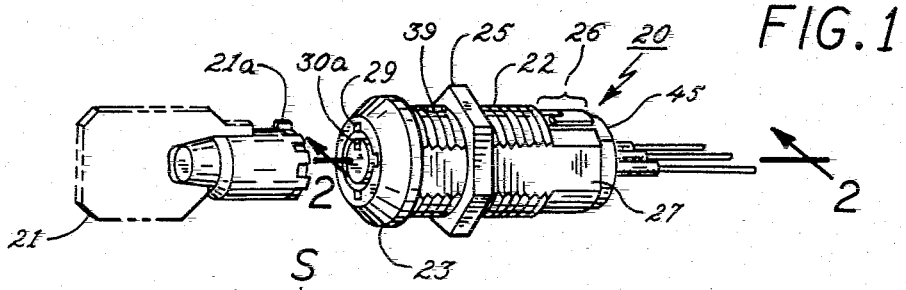
FIG. 1 is a side perspective view of an axial pin tumbler lock incorporating a switch mechanism assembly and the cooperating tubular key, in accordance with the present invention.

Turning to the drawings, there is illustrated in FIG. 1, the generally conventional appearing arrangement for an axial pin tumbler type of lock, indicated at 20, to be operated by a typical tubular key indicated at 21. Locks and keys of this general type are illustrated, for example, in U.S. Pat. Nos. 3,041,086 and 3,059,748.

Figure 2:
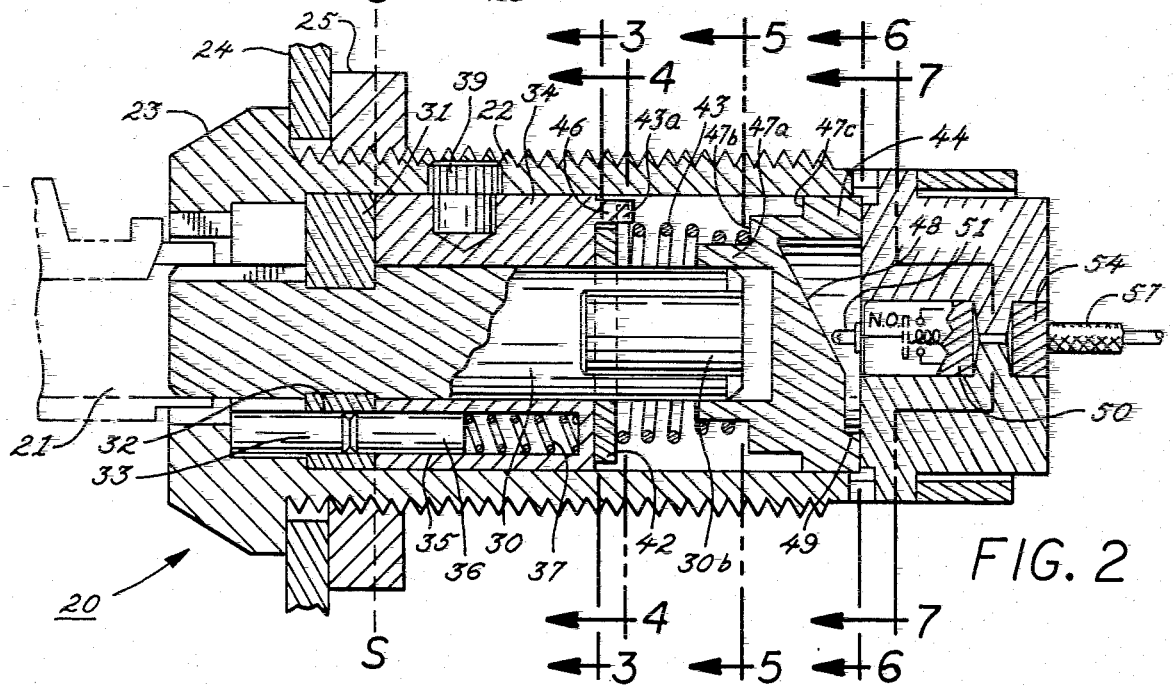
FIG. 2 is a fragmentary cross-sectional view of the tubular axial pin tumbler lock embodying the invention, taken substantially along the line 2—2 of FIG. 1.
Figure 3:
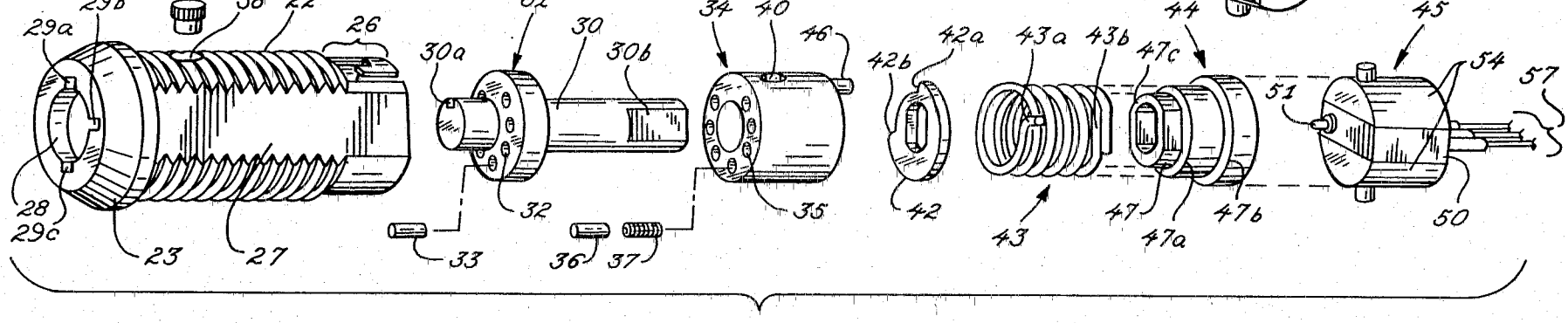
FIG. 3 is an exploded perspective view of the lock mechanism of FIG. 1, including the switch mechanism assembly according to the present invention.

Referring collectively to FIGS. 1, 2 and 3, the lock 20 is shown to include an elongated threaded tubular body 22 with an enlarged frustoconical head 23 which enables the lock body to be captively held to a metal cabinet 24 or the like by means of a mounting hex-nut 25, again in the conventional manner. The tubular lock body also has an unthreaded rear portion 26 which constitues the switch assembly retention area and its function will be described in detail below.

Referring particularly to FIGS. 2 and 3, the lock body 22 has a longitudinally extending bore and includes a flat portion 27 on its rear end. The frustoconical head 23 includes a reduced diameter opening 28 corresponding to the outer diameter of the tubular key 21. Around the reduced diameter opening, the frustoconical head 23 is provided with slots 29*a*, 29*b* and 29*c* which cooperate with the key lug 21*a* provided on the tubular key 21.

The main operational element of the lock mechanism is the spindle 30 which carries fixed thereto a driver pin sleeve 31 having a plurality of spaced longitudinally extending bores 32. A portion of the spindle 30 extends beyond the driver sleeve 31 towards the front portion of the lock and has a keyway 30*a* defined on it which allows the tubular key to be positioned over the spindle in order to actuate the locking action. The particular axial pin tumbler lock shown is a 7 pin tumbler type so that there are the same number of drive pins 33 disposed within each of the bores, although only one such driver pin 33 is shown here. The lock 20 also has a stationary tumbler sleeve 34 which has a central longitudinally extending bore for receiving the spindle 30. The tumbler sleeve 34 contains a plurality of spaced tumbler bores 35, each of which is adapted to receive a tumbler locking pin 36. Coiled compression spring elements 37 are disposed within the tumbler bores 35 and function to invariably urge the tumbler pins 36 forward.

With the driving and locking tumbler pins in place and the spindle seated on the stationary sleeve 34, the locking mechanism when assembled to the lock body 22 normally prevents rotation of the spindle 30. More specifically, the outer ends of the tumbler pins normally project outward beyond a so-called shear plane S—S formed at the interface of the outer end of the tumbler sleeve 34 and the inner end of the driver sleeve 31, and into the corresponding bores defined within the driver sleeve. The tumbler pins 36 thus normally lock the driver sleeve 31 and the spindle 30 against rotational motion relative to the tumbler sleeve 34. But such rotational motion is made possible when the tumbler pins are placed rearwardly in such a fashion that the forward ends of all of the pins lie exactly at the shear plane S—S. The rearward displacement of the tumbler pins in order to align them with the shear plane is affected by the driver pins 33 positioned within the bore of the driver sleeve in an axially slidably manner so that the inner ends of the driver pins engage with the outer ends of corresponding tumbler pins.

The rearward displacement of the driver pins themselves is normally brought about by a proper tubular key 21 which functions to displace the driver pins 33 rearwardly through the bores 32 within the driver sleeve 31, and against the forward ends of the tumbler pins 36. Generally, at least some of the driver pins are of different lengths so that only a properly coded key will effectively cause the rear ends of all of the tumbler pins 36 to be simultaneously aligned at the shear plane S—S.

The tubular lock body also has a threaded hole 38 defined through it in the area in which the tumbler sleeve 34 fits inside the tubular body. The hole 38 is adapted to receive a threaded retaining pin 39 which passes through the hole 38 into a corresponding threaded retaining pin hole 40 defined on the surface of the tumbler sleeve 34. When the retaining pin 39 is so held in position it functions to rigidly secure together the various components of the lock assembly within the tubular lock body 22.

The tubular lock described so far is conventional and is coded to be opened by placing driver pins 33 of different lengths inside predetermined ones of the holes 32 within the driver sleeve 31.

In accordance with the present invention, the lock assembly described above is adapted to provide a plurality of functions, each having electrical switching capability, by the provision of a multiple operation switch assembly adapted to be received by the rear of the lock housing in a manner such that rotations of the lock spindle by using a proper key will open and close the make and break contact button of an electrical switch thereby rendering the lock operable as a switch lock.

The switch assembly comprises a cam stop plate 42, a torsion spring 43, a cam actuator 44 and a switch subassembly 45. The cam stop plate 42 is a circular plate with an arcuate portion of its periphery cut out to define distinct edges 42a and 42b which cooperate with the lock pin 46 on the tumbler sleeve 34 to define the limits of circular motion to which the spindle 30 may be subjected to by the rotational motion of the tubular key 21. The torsion spring 43 is generally circular except for a flattened end portion 43b. The spring also has an extended spring leg 43a adapted to be hooked around the lock pin 46 on the tumbler sleeve to provide torsional action.

Figure 4:
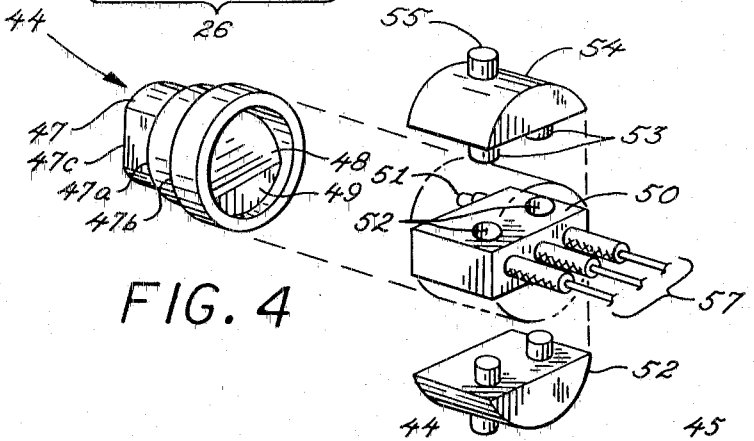
FIG. 4 is an exploded perspective view of the lock switching subassembly, according to the present invention, clearly showing the two contact elements of the switching subassembly.

The cam actuator 44 consists of three distinct stepped portions 47, 47a and 47b. The stepped portion 47 has a flattened portion 47c which defines an inner perimeter adapted to accept a flattened portion 30b on the rear end of the lock spindle 30. The flat rear portion 43b of the torsion spring 43 is adapted to fit over the flat section 47c of the first stepped section 47 while resting against the second stepped portion 47a of the cam actuator 44. The third stepped portion 47b has an increased diameter which corresponds to the inner diameter of the tubular lock body 22 and provides a smooth fit of the cam actuator within the lock body. The cam actuator 44 is also provided, on its end remote from the flattened portion 47c, with a contoured surface including a flat portion 49 and an inclined cam surface 48 (see FIG. 4).

The switch subassembly 45 basically consists of a micro switch 50 having a spring actuated make/break switch button 51 which brings about the actual electrical switching action depending on whether it is in its normal undepressed position, when no contact is made, or in its depressed position, when electrical contact is made. The switch 50 also has a pair of holes 52 defined through its cross section which are adapted to receive corresponding projections 53 formed on the inner surface of a pair of switch housings 54. The respective dimensions of the switch holes 52 and the inner projections 53 are chosen in such a way as to have a tight fit between the two. When the two switch housings 54 are fitted on diametrically opposite ends of the switch 50, the three components together form a cylindrical switch subassembly with dimensions that allow it to be slidably positioned inside the switch retaining area 26 of the lock tubular body 22.

When the lock is assembled in any one of its multiple locking functions, the switch button 51 on the switch subassembly 45 normally rests within the gap provided inside the outer shoulder of the cam actuator by virtue of the inclinded surface 48. In such a position the switch button 51 is in its undepressed mode and no electrical contact is established within the microswitch 50. When the proper tubular key 21 is used to turn the spindle 30 of the lock, a corresponding rotational motion is produced on the cam actuator 44 thereby bringing the flat surface of the actuator in contact with the switch button 51. This in turn depresses the switch button and actuates electrical contact within the micro switch 50. The switch 50 in this illustrous case is shown to have three exiting wire leads 57 which provide both single pole/-double throw as well as single pole/single throw actions depending on which of the three wires are used for switching. It will be understood by those skilled in the art that this invention is not limited to the use of a particular kind of switch but may be used with any type of switch which may be actuated by the rotational motion of the cam actuator 44.

Figure 5:
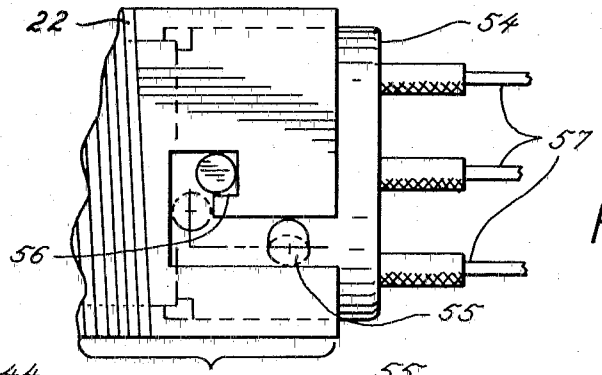
FIG. 5 is a side view of a portion of the multiple operation switch lock of FIG. 1 showing how the switch mechanism assembly fits into the rear portion of the lock.

Each of the switch housings 54 has on its outer surface an outer projection 55 which is adapted to fit into either of a pair of L-shaped switch slots 56 defined in diametrical opposition to each other on the unthreaded switch retaining area 26, as shown in FIG. 5. In effect, once the rest of the lock assembly has been put together on the basis of the desired locking action, the switch subassembly 45 can be fitted onto the rear portion of the tubular lock body by positioning the outer projections 55 of the switch housings 54 into the corresponding switch slots 56 of the switch retaining area 26, moving the switch subassembly along the slot 56, in effect compressing the spring element 43, and then twisting the subassembly slightly in the clockwise direction until the outer projections 55 get locked in position against the inner arm of the switch slot 56. Such an arrangement provides a simple assembly and disassembly means for the switch assembly. For example, removing the swith subassembly 45 from its locked position can be accomplished by pressing the assembly inwards, again in effect compressing the spring 43, and giving it a slight counterclockwise twist whereby the subassembly pops out by itself along the outer arm of the switch slot 56.

The lock, according to this invention, is adapted for multiple key pulls by the key lug slots positioned on the reduced diameter opening of the frustoconical head. Specifically, the first slot 29a is positioned to be in line with the retaining pin 39 and the slots 29b and 29c are displaced at angles of 90° and 180°, respectively, with respect to the first slot (see FIGS. 1 and 3).

According to an important aspect of this invention, the lock assembly is made totally separate from the multiple operation switch assembly. Any change in the type of locking action desired of the lock can be made without any disassembly of the lock assembly itself. In other words, once the lock assembly has been put together and held in position by the retaining pin there is no need for it to be disassembled in order to shift from one locking function to another. The only portion that has to be disassembled is the multiple operation switch assembly and this is accomplished easily, as described above, by twisting the switch subassembly and pulling the outer projections on the surface of the switch housings out of the key slot on the switch retention area of the tubular lock body. Subsequently, the cam stop plate, the torsion spring and the cam actuator may be removed in order to be rearranged relative to the lock spindle to adapt the lock for a different locking function.

Referring now to FIGS. 6–11, the description below describes the relative arrangement of the multiple operation switch assembly onto the lock assembly required to operate the lock in its first locking functions, which provides for momentary electrical contact with key spring back and a key pull at the 12 o'clock position as described below. The initial step after disassembling the multiple opertaion switch assembly is to use the proper key to align the spindle keyway 30a with the key lug slot 29a that is proximate to the retaining pin 39, with the lock assembly being held in the position shown in FIG. 6. This constitutes the reference 12 o'clock position (electrical 'off') for the first and second locking functions to be described below, and when the spindle 30 and hence the keyway 29a is rotated clockwise by 90° to reach the 3 o'clock (electrical 'on') position, the key lug slot 29b is available for key removal.

Figure 7:
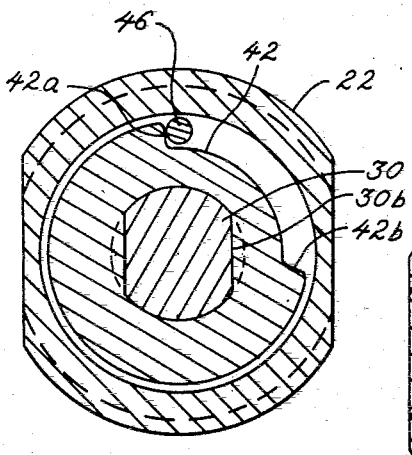
FIG. 7 is a transverse sectional view taken substantially along the line 3—3 in FIG. 2.
Figure 8:
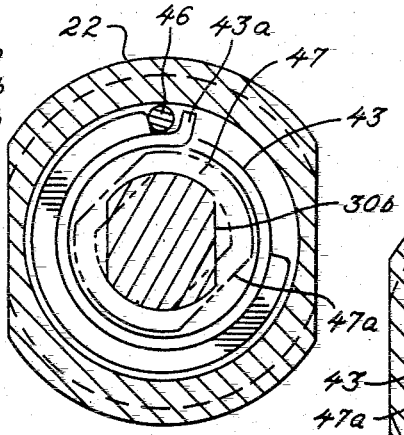
FIG. 8 is a transverse sectional view taken substantially along the line 4—4 in FIG. 2.
Figure 9:
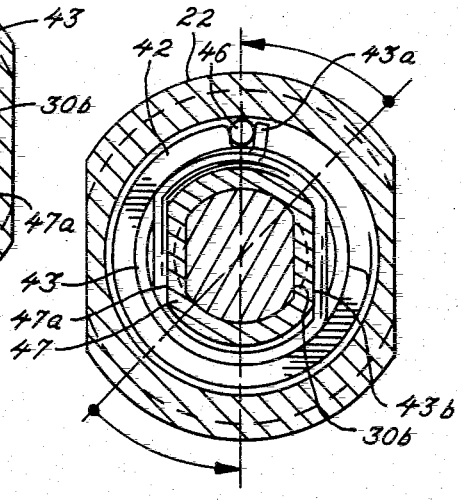
FIG. 9 is a transverse sectional view taken substantially along the line 5—5 in FIG. 2.

Referring now to FIG. 7, the cam stop plate 42 is fitted over the spindle 30 in such a way that its top edge 42a is aligned to the left of the lock pin 46. It will be noted that the flat portion 43b of the torsion spring 43 fits tightly over the corresponding flat portion 47c of the cam actuator 44. Hence, for all practical purposes, the spring 43 and the cam actuator 44 can be considered as a single component. After the cam stop plate 42 has been positioned as shown in FIG. 7, the spring 43 and hence the cam actuator 44 is positioned over the spindle 30 in such a way that the spring leg 43*a* of the spring 43 is positioned to the right of the lock pin 46 (see FIG. 8). At the next stage, the spring and actuator assembly is twisted counterclockwise against the torsional strength of the spring 43 provided by the locking action of the spring leg 43*a* against the lock pin 46, until the flat portion 47*c* of the cam actuator 44 aligns with the corresonding flat portion 30*b* of the spindle 30 (FIG. 9). The actuator assembly is then depressed against the compression force of the spring 43 so that the flat portion 30*b* of the spindle moves into the hollow area defined within the flat portion 47*c* of the cam actuator.

Figure 11:
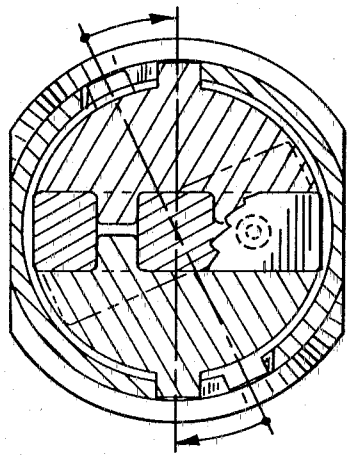
FIG. 11 is a transverse sectional view taken substantially along the line 7—7 in FIG. 2.
Figure 10:
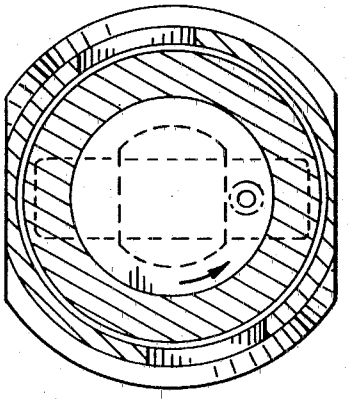
FIG. 10 is a transverse sectional view taken substantially along the line 6—6 in FIG. 2.

At this point, the cam actuator 44 is subject to two distinct forces; one is the compression force of the spring against which the cam actuator is forced onto the flat portion of the spindle and the other is the torsional force existing because of the anticlockwise motion that the actuator has undergone, while keeping the spring leg 43*a* locked against the lock pin 46, in order to align the flat portion 47*c* of the cam actuator with the flat portion 30*a* of the lock spindle. Without allowing any of these forces to dissipate, the switch subassembly 45 is then placed over the cam actuator and locked into position, as described above, by twisting the assembly clockwise until the outer projections 55 of the switch housings 54 are secured into position within the switch slots 56 on the switch retaining area 26 of the lock tubular body 22 (FIGS. 10 and 11). The lock is now set to function in its momentary spring back mode.

If a proper tubular key is now inserted into the lock at the 12 o'clock position and used to turn the lock spindle 30 in a clockwise direction (counterclockwise as seen in FIGS. 6–11), the clockwise motion of the spindle is restricted because of the cam stop plate. More specifically, the lower edge 42*b* of the arcuate periphery of the cam stop plate 42 comes into contact with the lock pin 46 and limits further clockwise motion of the lock spindle 30. In the illustrious case the arcuate periphery of the cam stop plate is defined in such a way that the clockwise motion of the locking spindle is restricted to 90° with respect to the reference 12 o'clock position. It will also be noted that the above clockwise motion of the spindle is exerted against the torsional force of the spring 43 since the spring leg 43*a* is locked against the lock pin 46. In effect, this arrangement allows the lock spindle 30, and hence the key being used to turn the spindle, to spring back because of the torsional effect of the torsion spring 43.

As described above, the switch subassembly 45 is assembled on to the cam actuator in such a way that, with the spindle at the reference 12 o'clock position, the switch button 51 of the microswitch 50 rests within the gap formed inside the cam shoulder 47*b* because of the cam surface 48. When the key is used to turn the lock spindle 30 clockwise, the flat surface 49 of the cam actuator comes into contact with the switch button 51. This contact occurs when the lock spindle has been rotated to such an extent that the edge 42*b* of the cam stop plate 42 abuts the lock pin 46 and causes the switch button to be depressed, which in turn causes an electrical contact to be established within the microswitch 50. Once the twisting force exerted on the tubular key is removed, the spindle 30, as described above, springs back under the torsional forces of the torsion spring, the flat surface 49 of the cam actuator loses contact with the switch button 51 and the electrical contact established earlier is broken. The above arrangement thus provides an open electrical contact at the 12 o'clock position and momentarily closed electrical contact with key spring back at the 3 o'clock position while providing key pull at the 12 o'clock position.

Figure 12:
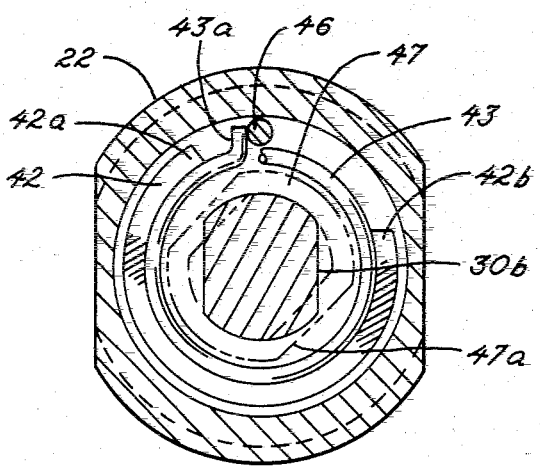
FIG. 12 is a transverse sectional view taken substantially along the line 4—4 in FIG. 2, for the second and third locking actions of the lock, with the lock being in the electrically 'open' position.

The second locking function of the lock is one which provides fixed switch contact with two key pulls at the 12 o'clock and 3 o'clock positions, respectively. Transfer from the first locking function, that is the one which provides momentary spring back contact, to the second locking function is extremely simple. The switch subassembly 45 is depressed against the compression force of the spring 43 and rotated counterclockwise so that the outer projections 55 on the switch housings 54 are unlocked from the inner arm of the switch slot 56 and as a result the switch subassembly 45 pops out of the switch slot 56. This motion also causes the cam actuator 44 and hence the torsion spring attached to it to be pulled back because of the compression forces of the spring. This in turn frees the spring leg 43*a* from the confines of the lock pin 46, and hence the twisting force to which the spring had been subjected because of the clockwise motion of the cam actuator in order to align its flat portion with the flat portion of the lock spindle, is released. The spring leg 43*a* moves away from the lock pin 46 and comes to rest at a position which is to the left of the lock pin 46 as shown in FIG. 12.

At this point, the switch subassembly 45 is repositioned into the switch retaining area 26 and locked into position within the switch slots 56. The depression of the spring 43 which is required in order to lock the switch subassembly within the switch slot causes the flat portion 30*b* of the spindle 30 to be positioned within the gap defined by the flat portion 47*a* of the cam actuator 44. Since the spring leg 43*a*, in this instance, is located to the left of the lock pin 46 there is no restriction to the rotational motion of the spring 43 and hence the cam actuator 44 is also free to rotate with the lock spindle 30. But, as in the earlier instance of the lock functioning in the first mode, the rotational motion of the lock spindle 30 is restricted by the cam stop plate 42 to the point where the edge 42*b* of the cam stop plate abuts the lock pin 46 (see FIG. 12). But in this instance, since the torsion spring 43 is not locked against the lock pin 46, once the key is used to rotate the lock spindle 30 clockwise until the cam stop plate prevents further rotation, there is no spring back of the key and the spindle stays in the position shown in FIG. 13.

Figure 13:
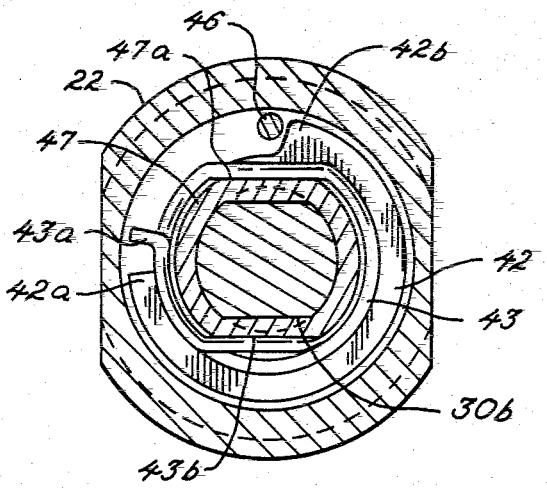
FIG. 13 is a similar transverse sectional view with the lock being in the electrically 'closed' position.

The motion of the cam actuator, however, remains the same as in the first locking function. More specifically, when the spindle is rotated clockwise (counterclockwise as seen in FIGS. 12 and 13) the cam actuator 44, which originally rests in such a position that the cam surface 48 faces the switch button 51, rotates along with the rotational motion of the lock spindle and when the rotational extent of the spindle as defined by the edge 42*b* of the cam stop plate is reached the flat surface of the cam actuator comes into contact with the switch button 51 and depresses it thereby establishing electrical contact. Since there is no spring back of the lock spindle the cam actuator remains in the switch depressing position until further rotation of the lock spindle is actuated.

Since the reduced diameter portion of the frustoconical head 23 is also provided with the key lug slot 29*b* at the 3 o'clock position (FIG. 1), when the key is used to turn the lock spindle and place it with the spindle keyway into the position shown in FIG. 13, the key can be removed, thereby leaving the switch subassembly in the contact established position. This electrical contact is maintained until the key is used to turn the lock spindle counterclockwise until the key is located back at the 12 o'clock position where it can be removed. During this return motion the cam actuator is rotated along with the lock spindle so that the flat surface 49 of the cam actuator is moved out of contact with the switch button 51 thereby breaking the earlier established electrical contact. The above described locking function thus provides an open electrical contact at the 12 o'clock position and a closed electrical contact at the 3 o'clock position of the lock spindle while providing key pulls at both the 12 o'clock and 3 o'clock positions.

The third locking function of the lock provides fixed switch contact with one key pull at the 12 o'clock position with the electrical switch being normally open with the key at the 12 o'clock position and normally closed with the key at the 3 o'clock position. According to this invention, transfer from either the first locking function or the second locking function, as described above, to the third locking function is convenient. The first step in such a conversion is to disassemble the switch subassembly 45 from the switch retaining area 26 of the lock assembly. As described above, the switch subassembly 45 is depressed against the compression force of the spring 43 and rotated counterclockwise so that the outer projections 55 on the switch housings 54 are unlocked from the inner arm of the switch slot 56 and the switch assembly 45 moves out of the switch slot 56. Subsequently, the cam actuator 44, the torsion spring 43 attached to the cam actuator, and the cam stop plate 42 are removed from within the switch retaining area 26 of the tubular lock body 22.

Figure 14:
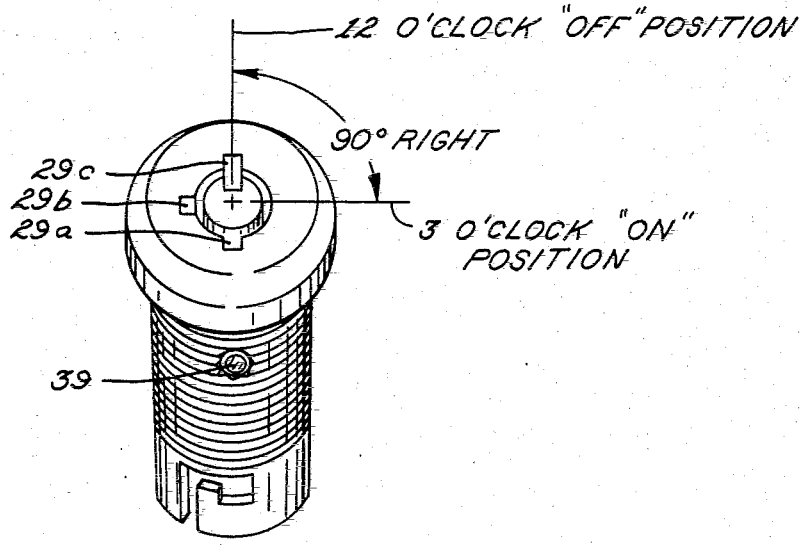
FIG. 14 is a frontal perspective view of the lock showing the respective locations of the key lug slots and the spindle keyway before assembling the lock for the third locking function.

The mounting position of the lock assembly is shifted by 180° as compared to the mounting position in the earlier locking functions. More specifically, the lock is now mounted with the retaining pin 39 facing downwards as shown in FIG. 14. In this altered reference position the keyway slots **29*a*, 29*b*, 29*c* on the frustoconical head 23 of the lock assembly are now positioned at the 6 and 9 and 12 o'clock positions, respectively. The proper key is now used to rotate the lock spindle in such a way that the spindle keyway 30*a*** is aligned at the new 12 o'clock reference position.

Figure 6:
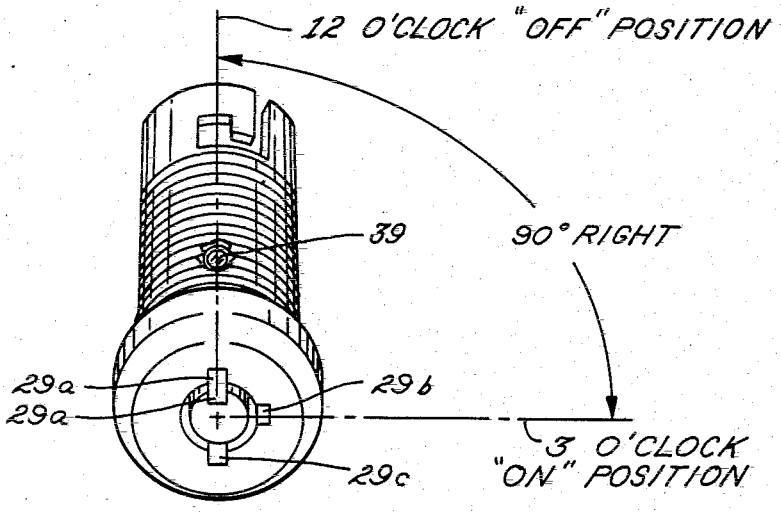
FIG. 6 is a frontal perspective view of the multiple operation switch lock of FIG. 1 showing the respective locations of the key lug slots and the spindle keyway before assembling the lock for the first and second locking functions.

The rest of the reassembly procedure is similar to that described above for the second locking function. Specifically, the cam stop plate 42 is fitted over the spindle 30 in such a way that its top edge **42*a* is aligned to the left of the lock pin 46 (FIG. 6). Next, the torsion spring 43 and the cam actuator 44 to which the spring is attached are positioned over the spindle 30 while ensuring that the spring leg 43*a* of the spring 43 is positioned to the left of the lock pin 46 (FIG. 12). At this point, the switch subassembly 45 is repositioned into the switch retaining area 26 and locked into position within the switch slots 56. The flat portion 30*b* of the spindle 30 gets positioned within the gap defined by the flat portion 47*c* of the cam actuator 44 because of the compression of the spring 43** required in order to lock the switch subassembly within the switch slot.

As in the case of the second locking function, there is no restriction to the rotational motion of the spring 43 since the spring leg **43*a* is located to the left of the lock pin 46, and hence the cam actuator 44 is free to rotate along with any rotational motion of the lock spindle 30. However, the rotational motion of the lock spindle 30 is restricted by the cam stop plate 42 to the point where the edge 42*b* of the cam stop plate abuts the lock pin 46 (FIG. 13). But, since the torsion spring 43 is not locked against the lock pin 46 there is no spring back of the key and the spindle is retained in the position shown in FIG. 13, once the key is used to rotate the lock spindle 30** clockwise until the cam stop plate prevents further rotation.

The actual motion of the cam actuator 44, and the effect of its contoured surface on the microswitch 50 of the switch subassembly 45 remains the same. More specifically, when the spindle is rotated clockwise (counterclockwise as seen in FIG. 14), the cam actuator 44 which has its cam surface 48 facing the switch button 51 rotates along with the rotational motion of the lock spindle and when the rotational extent of the spindle as defined by the edge **42*b* of the cam stop plate is reached, the flat surface of the cam actuator comes into contact with the switch button 51** and depresses it, thereby establishing electrical contact. Since there is no spring back of the lock spindle, the cam actuator remains in its altered position until further rotation of the lock spindle is actuated.

Because the lock tubular body is mounted with the retaining pin facing downwards (FIG. 14) there is no key lug slot available at the 3 o'clock position. Hence, after the lock spindle has been rotated from the 12 o'clock position to the 3 o'clock position, where electrical contact is established within the microswitch, there is no retrieval path to remove the tubular key from its position over the lock spindle. The only way to remove the key is to rotate it counterclockwise through 90° in order to have the spindle keyway **30*a* aligned at the 12 o'clock position. During this return motion the cam actuator 44 is rotated along with the lock spindle so that the flat surface of the cam actuator is moved out of contact with the switch button 51 thereby breaking the earlier established electrical contact as the switch button 51** comes to rest in its undepressed position. Since the keyway is now aligned with the available key lug slot at the 12 o'clock position, the key can be removed from the lock. The above described locking function thus provides an open electrical contact at the 12 o'clock position and a closed electrical contact at the 3 o'clock position of the lock spindle while providing key pull only at the 12 o'clock position.

It will be understood by those skilled in the art that the invention is not restricted to the particular kind of axial pin tumbler lock described in the illustrous embodiment; similar types of locks which also include other features such as special driver pins for increased pick resistance may be used just as conveniently.

As is apparent from the above description, the multifunction switch lock according to the system of this invention provides a plurality of mechanical locking functions for the lock while at the same time providing the lock with electrical switching capabilities. A distinct advantage of this embodiment is that the lock assembly does not have to be taken apart in order to transfer the lock from one locking function to another. Disassembly of the lock mechanism in order to change the locking function as well as to gain access to the contact elements for rekeying, maintenance or repair purposes is made extremely convenient. For example, it will be noted that in order to transfer the lock from the first locking function to the second or vise versa, the lock mechanism does not have to be dismounted from the cabinet or the like surface to which it has been mounted. Instead, the change in function can be accomplished by easily disengaging the switch subassembly from the switch retaining area of the lock body and reassembling the switch asembly as described above. The invention thus provides an axial pin tumbler lock which has both multiple locking functions as well as electrical switching capabilities in a simple and conveniently disassembled and reassembled form and yet uses a minimum number of moving parts. The arrangement results in an efficient, convenient as well as economical multiple operation switch lock which may be installed easily and requires reduced repair and maintenance.

I claim:

1. A key actuated tubular lock capable of a plurality of locking functions, each with switch operating capability, said lock comprising:

an outer substantially cylindrical barrel having forward and rear ends, a stationary tumbler sleeve having forward and rear ends telescoped into the rear end portion of said barrel, a locking spindle extending through and rotatably mounted in said stationary tumbler sleeve, a rotatable driver sleeve fixed to said spindle and disposed within said barrel in face-to-face relation with the forward end of said stationary tumbler sleeve, axially extending and angularly spaced driver and tumbler pins slidably mounted in holes in said stationary tumbler sleeve and said rotatable driver sleeve and normally operable to prevent rotation of said spindle with respect to said stationary tumbler sleeve, a multiple operation switch operating assembly adapted to be operated by rotation of said locking spindle through use of a proper key, said switch assembly comprising:

a first member adapted to be received to be receiver over the spindle for rotation therewith, said member having means adapted to interfit with stop means provided on the rear end of said stationary sleeve, a second member having a front end adapted to be coupled to said spindle for rotation therewith and a rear end having a contoured cross sectional surface, spring means interposed between said first and second members and rigidly attached in a removable manner to the latter, said spring also having means capable of abutting said stop means on the stationary sleeve in order to offer resistance to rotational motion of said second member, and a switch subassembly, including a microswitch and a switch operating member associated therewith, positioned with said operating member facing said contoured surface on the second member whereby the operating member is contacted so that said microswitch is off when the locking spindle is in a first position and on when the spindle is key actuated to a second position, said first and second members and said spring means of the multiple operation switch assembly being adapted to be assembled according to a plurality of arrangements so that they coact differently with each other and with said stop means on said stationary sleeve, thereby providing the plurality of locking functions for the lock.

2. The multiple operation switch lock of claim 1 wherein said stop means on said first member comprises an arcuate periphery defining two distinct edges and said stop means on the stationary sleeve is a cylindrical pin member projecting from the rear end of said sleeve so that rotation of said first member and said locking spindle is prevented whenever one of the edges of said first member abuts said pin member.

3. The multiple operation lock of claim 2 wherein said contoured surface on the second member comprises a substantially flat surface adapted to contact and depress the operating member when the surface is positioned adjacent to said member, and a cam surface angularly inclined away from said flat surface and making no contact with said operating member when positioned adjacent to said member, said surfaces alternately moving into and out of adjacent relationship with the switch operating member upon rotation of the key actuated spindle.

4. The multiple operation switch lock of claim 3 wherein said switch subassembly includes a pair of housings adapted to be removably fitted on opposite ends of the microswitch in order to provide a substantially cylindrical shape to said switch subassembly, said housings each having locking means provided on the outer surface, said means interfitting with corresponding means provided on said outer barrel so that the switch subassembly may be locked into position within the barrel.

5. The multiple operation switch lock of claim 4 wherein said locking means on the housings are members projecting radially outwards, and said locking means on the barrel are L-shaped slots adapted to receive said projecting members in such a manner as to retain said switch subassembly within the outer barrel.

6. The multiple operation switch lock of claim 1 wherein said first and second member and said spring means are so arranged that they coact with each other and with said stop means on said stationary sleeve in such a way that when the propery key is used to actuate the lock by turning the locking spindle from said first position to said second position, said spindle and said key spring back to said first position of the spindle.

7. The multiple operation switch lock of claim 1 wherein said first and second members and said spring means are so arranged that they coact with each other and with said stop means on said stationary sleeve in such a way that the proper key may be used to actuate the lock by turning the locking spindle from said first position to said second position or vice versa, said arrangement permitting said key to be inserted and removed at both of said spindle positions.

8. The multiple operation switch lock of claim 1 wherein said first and second members and said spring means are so arranged that they cooperate with each other and with said stop means on said stationary sleeve in such a way that the proper key may be used to actuate the lock by turning the locking spindle from said first position to said second position or vice versa, said arrangement permitting said key to be inserted and removed only at said first spindle position.

9. In a lock having a substantially cylindrical outer barrel and key actuated locking spindle means, including a stationary sleeve and a rotatable sleeve each having forward and rear ends, disposed in said barrel, a multiple operation switch operating assembly adapted to be operated by rotation of said locking spindle through use of a proper key and capable of providing the lock with a plurality of locking functions, each with switch operating capacility, said assembly comprising:

a first member adapted to be received over the spindle for rotation therewith, said member having means adapted to interfit with corresponding stop means on the rear end of said stationary sleeve, a second member having a front end adapted to be coupled to said spindle for rotation therewith and a rear end having a contoured cross sectional surface, spring means interposed between said first and second members and rigidly attached in a removable manner to the latter, said spring also having means capable of abutting said stop means on the stationary sleeve in order to offer resistance to rotational motion of said second member, and a switch subassembly, including a microswitch and a switch operating member associated therewith, positioned with said operating member facing said contoured surface on the second member whereby the operating member is contacted so that said microswitch is off when the locking spindle is in a first position and on when the spindle is key actuated to a second position, said first and second member and said spring means of the multiple operation switch assembly being adapted to be assembly according to a plurality of arrangements so that they coact differentialy with each other and with said stop means on said stationary sleeve, thereby providing the plurality of locking functions for the lock.

10. The multiple operation switch operating assembly of claim 9 wherein said stop means on said first member comprises a an arcuate periphery defining two distinct edges and said stop means on the stationary sleeve is a cylindrical pin member projecting from the rear end of said sleeve so that rotations of said first member and said locking spindle is prevented whenever one of the edges of said first member abuts said pin member.

11. The multiple operation switch operating assembly of claim 10 wherein said contoured surface on the second member comprises a substantially flat surface adapted to contact and depress the operating member when the surface is positioned adjacent to said member, and a cam surface angularly inclined away from said flat surface and making no contact with said operating member when positioned adjacent to said member, said surfaces alternately moving into and out of adjacent relationship with the switch operating member upon rotation of the key actuated spindle.

12. The multiple operation switch operating assembly of claim 11 wherein said switch subassembly includes a pair of housings adapted to be removably fitted on opposite ends of the microswitch in order to provide a substantially cylindrical shape to said switch subassembly, said housings each having locking means provided on the outer surface, said means interfitting with corresponding means provided on said outer barrel so that the switch subassembly may be locked into position within the barrel.

13. The multiple operation switch operating assembly of claim 12 wherein said locking means on the housings are members projecting radially outwards, and said locking means on the barrel are L-shaped slots adapted to receive said projecting members in such a manner as to retain said switch subassembly within the outer barrel.

14. The multiple operation switch operating assembly of claim 9 wherein said first and second member and said spring means are so arranged that they coact with each other and with said stop means on said stationary sleeve in such a way that when the proper key is used to actuate the lock by turning the locking spindle from said first position to said second position, said spindle and said key spring back to said first position of the spindle.

15. The multiple operation switch operating assembly of claim 9 wherein said first and second members and said spring means are so arranged that they coact with each other and with said stop means on said stationary sleeve in such a way that the proper key may be used to actuate the lock by turning the locking spindle from said first position to said second position or vice versa, said arrangement permitting said key to be inserted and removed at both of said spindle positions.

16. The multiple operation switch operating assembly of claim 9 wherein wherein said first and second members and said spring means are so arranged that they cooperate with each other and with said stop means on said stationary sleeve in such a way that the proper key may be used to actuate the lock by turning the locking spindle from said first position to said second position or vice versa, said arrangement permitting said key to be inserted and removed only at said first spindle position.

* * * * *

UNITED STATES PATENT AND TRADEMARK OFFICE

CERTIFICATE OF CORRECTION

PATENT NO. : 4,634,822

DATED : January 6, 1987

INVENTOR(S) : ALAN G. GOEKE

It is certified that error appears in the above-identified patent and that said Letters Patent is hereby corrected as shown below:

At col. 6, line 15, delete "swith" and insert -- switch --;

At col. 13, line 26, delete "assembly" and insert -- assembled --;

At col. 13, line 25, delete "differentialy" and insert -- differently --;

At col. 13, line 34, delete "a".

Signed and Sealed this

Tenth Day of November, 1987

*Attest:*

*Attesting Officer*

DONALD J. QUIGG

*Commissioner of Patents and Trademarks*